United States Patent [19]

Häring

[11] Patent Number: 4,823,530

[45] Date of Patent: Apr. 25, 1989

[54] THERMIC INSULATING COVERS FOR FAÇADE AND THE LIKE WALLS

[76] Inventor: Rolf A. Häring, Hauptstrasse 73, CH-4148 Pfeffingen, Switzerland

[21] Appl. No.: 938,033

[22] Filed: Dec. 4, 1986

Related U.S. Application Data

[63] Continuation-in-part of Ser. No. 859,918, Apr. 5, 1986, abandoned.

[30] Foreign Application Priority Data

May 8, 1985 [CH] Switzerland ..... 1943/85

[51] Int. Cl.[4] ..... E04B 1/94; E04B 1/70

[52] U.S. Cl. ..... 52/317; 52/232; 52/235; 52/302; 52/309.1

[58] Field of Search ..... 52/317, 266, 232, 302, 52/235, 309.1, 573

[56] References Cited

U.S. PATENT DOCUMENTS

| | | | |
|---|---|---|---|
| 2,392,552 | 1/1946 | Roe | 52/309.1 |
| 3,678,634 | 7/1972 | Wise et al. | 52/232 |
| 3,840,425 | 10/1974 | Finelli | 52/232 |
| 4,093,818 | 6/1978 | Thwaites et al. | 52/232 |
| 4,221,092 | 9/1980 | Johnson | 52/232 |
| 4,270,318 | 6/1981 | Carroll et al. | 52/232 |
| 4,272,643 | 6/1981 | Carroll et al. | 52/232 |
| 4,277,532 | 7/1981 | Czejsil et al. | 52/232 |
| 4,467,577 | 8/1984 | Licht | 52/232 |
| 4,493,173 | 1/1985 | Kohant | 52/232 |
| 4,559,745 | 12/1985 | Wexler | 52/232 |
| 4,561,228 | 12/1985 | Kaminaga | 52/235 |

FOREIGN PATENT DOCUMENTS

| | | | |
|---|---|---|---|
| 141368 | 5/1985 | European Pat. Off. | 52/232 |
| 208650 | 1/1987 | European Pat. Off. | 52/232 |
| 2052683 | 5/1972 | Fed. Rep. of Germany | 52/232 |
| 2162251 | 6/1973 | Fed. Rep. of Germany | 52/232 |
| 2613492 | 10/1976 | Fed. Rep. of Germany | 52/309.1 |
| 3404221 | 8/1985 | Fed. Rep. of Germany | 52/232 |
| 2254182 | 7/1975 | France | 52/232 |

*Primary Examiner*—Michael Safavi

*Attorney, Agent, or Firm*—Gilbert L. Wells; Heinrich W. Herzfeld

[57] ABSTRACT

A façade is heat-insulated by a number of synthetic resin foam panels extending in at least two horizontal facade regions one above the other, and being internally ventilated by ducts extending preferably at an angle of about 45° with a horizontal plane and intersecting each other. Between the two façade regions there extends horizontally a flame barrier having the configuration of a beam and containing barrier ducts each of which connects a ventilating duct in the lower facade region with another ventilating duct in the upper façade region. A groove or channel extending longitudinally in the beam can intersect the barrier ducts and have an open end which is preferably directed downwardly so that a fire in the lower facade region will cause a uniform heating of the groove and adjacent barrier ducts. Blocking agents, e.g. elongated strips are inserted in the groove or in each of the barrier ducts and are adapted to expand, especially by foaming, when a critical temperature limit is reached in the barrier ducts.

12 Claims, 5 Drawing Sheets

THERMIC INSULATING COVERS FOR FACADE AND THE LIKE WALLS

RELATIONSHIP TO EARLIER APPLICATION

This is a continuation-in-part of my earlier pending patent application Ser. No. 06/859,918 filed on Apr. 5, 1986, now abandoned.

BACKGROUND OF THE INVENTION

This invention relates to improvements in thermic insulating covers for façade and the like walls, and more particularly to such thermic insulating covers which are internally ventilated by being provided with ventilation channels extending from a lower to an upper end zone of the cover over the entire height of the façade.

The thermic insulating cover may also be at the same time sound-absorbing.

It is well known to thermically insulate buildings by covering their façade with insulating plates made of foamed synthetic resin material which are provided with a system of internal ventilating channels or ducts. Typical examples of such internally ventilated covers for façades have been described in my Swiss Pat. No. 648,888 and my European patent application No. 84.810.196.0. The ducts can extend vertically or, preferably, diagonally, e.g. at an angle of inclination of 45°, and they can be interconnected where they intersect one another. The façade cover consists usually of a number of prefabricated cover panels which are affixed on the underlying wall layer of the building by various known methods.

A problem caused by such façade covers is that they are usually not difficultly inflammable but quite combustible, and especially by the fact that the ventilation channels which extend in their interior, for instance close to their external surface, from the foot zone of the covered façade to its top zone, produce a so-called "chimney effect" in case of fire, causing hot air to rise in them upwards and drawing fresh air into the system at the foot zone, thereby rapidly spreading a fire in lower storeys of a building to the higher ones and to its roof.

The fire protection of openings for tubes and cables in the walls of buildings by passing such tubes or cables through fire protective blocks having a surface covered by a heat-foamable hydrated potassium or sodium silicate optionally covered in turn by a metal layer such as an aluminum foil has been recommended by Flamex Ltd., Nassau, Bahama Islands in their German Offenlegungsschrift No. 21 62 251 published on June 20, 1973. Other thermally expandable sealants have been disclosed in U.S. Pat. No. 4,277,532, granted to Hubert Czepel et al on July 7, 1981. However, this sealant contains chlorinated hydrocarbon phenol-formaldehyde, resins and asbestos fibers and is therefore undesirable for the purposes of the flame barrier according to the invention.

U.S. Pat. Nos. 3,678,634 granted to Eugene H. Wise et al on July 25, 1972 and 4,221,092 granted to William L. Johnson on Sept. 9, 1980, deal with the problem of rendering the junction zones where thermoplastic pipes pass through walls and floors of buildings fire-retarding.

OBJECTS AND SUMMARY OF THE INVENTION

It is an object of the invention to provide an internally ventilated thermic insulating cover for façades and the like walls which is free from the above-described drawback and will prevent the spreading of a conflagration, in particular of a fire, by way of the insulating cover and the internal ventilating ducts or channels therein.

It is another object of the invention to provide a thermic insulating façade cover having an internal system of ducts or channels, which is free from the danger of producing a "chimney effect" in the case of a fire erupting in or near part of the cover, which would involve a transfer of heat causing fire in a given space to "jump" to an adjacent space not directly contacted by the fire in the first space.

These objects and others which will become apparent from the further description of the invention, are attained in accordance with the invention, in a thermic insulating facade cover of the initially described kind, which comprises, on a façade, at least one lower section of wall cover, at least one other, higher section of wall cover thereabove, all sections present together covering the entire or a larger portion of the façade, and at least one flame barrier interposed between a lower and at least one next adjacent other section of wall cover thereabove, and extending substantially horizontally at the top end of said lower section, and at the foot end of said higher section, so as to completely separate said lower from said higher section.

More, in particular, the flame barrier has the configuration of a beam or block, preferably of rectangular cross section with a preferably horizontally extending lower beam face resting on the upper end of the insulating cover plate or plates therebelow, and an upper face, also preferably extending horizontally, which supports the lower end of the insulating cover plate or plates thereabove.

The flame barrier beam or block comprises ducts each having a lower duct orifice in the aforesaid lower beam face and an upper duct orifice in the upper beam face; the lower duct orifices are adapted to register with corresponding orifices of ventilating channels or ducts in the lower end of the insulating cover plate or plates above the flame barrier-constituting beam. These flame barrier ducts must be inclined at an acute angle relative to the above-mentioned upper and lower faces of the flame barrier body.

In the ducts of the flame barrier beam there are placed, preferably near the lower row of orifices in the lower beam face, duct-blocking means which preferably comprise a heat-foamable or swellable fire-resistant chemical composition and which are adapted to considerably reduce the free cross-sectional area of the beam ducts or to close them off completely. 80% of the cross-sectional area of the beam ducts in the flame barrier beam should be closed off by the duct-blocking means in the case of the temperature in the ducts rising to a critical temperature activating the blocking means to foam or swell and narrow or close off the beam ducts.

In order to make the blocking means in the beam ducts rapidly responsive to the temperature prevailing in the ventilating channels with which the duct orifices nearest the blocking means register, the ducts extend preferably through at least part of the flame barrier beam at the same angle of inclination as the ventilating channels.

In a preferred embodiment of the façade insulation according to the invention, the flame barrier comprises, besides the barrier ducts extending from the lower to the upper face of the barrier (either vertically to the horizontal plane or, optimally, at an angle other than a right angle, and being preferably identical with the angle of inclination of the ventilating ducts in the adjacent facade regions below and above), an elongated transverse channel or groove extending substantially horizontally and transversely to the barrier ducts and intersecting the same so as to be in free communication with the region ducts therebelow and thereabove up to a temperature limit.

I have found that a transverse groove is preferably so disposed in the flame barrier body that it opens downwardly, whereby the heat of flames flashing upward through the ventilating channels of the lower façade region is distributed rapidly and evenly over the entire width of the façade, so that all zones of the blocking means housed in that transverse groove will be heated to the critical temperature simultaneously and expand, closing the paths to the ventilating ducts in the upper facade region uniformly and thereby preventing the fire from "jumping" the flame barrier locally and from spreading into the façade regions above the barrier.

The fire-resistant composition consists preferably of hydrated sodium silicate (e.g. water glass), reinforced by inlays of fire-resistant fibers or wires, and foaming agent.

The cross-sectional area of a beam duct equipped with the blocking agent is preferably so dimensioned as to take into account the capacity for swelling or foaming of the chemical composition so that in the case of the critical temperature being attained in the duct, the swelling or foaming of the blocking agent will close off at least 80% of the cross-sectional area of the duct.

The beam constituting the flame barrier should be heat-insulating and preferably itself non-combustible, and could be made of such material as mineral fiber wool, glass wool, asbestos fibers, cork, perlite, foamed water glass, polyurethane rendered difficulty inflammable by the addition of inert, especially mineral fillers, or a mixture of at least two of these materials.

BRIEF DESCRIPTION OF THE DRAWINGS

Further details and advantages of the invention will become apparent from the following description thereof with reference to the accompanying drawings in which.

DETAILED DESCRIPTION OF THE EMBODIMENTS SHOWN IN THE DRAWINGS

Figure 1:
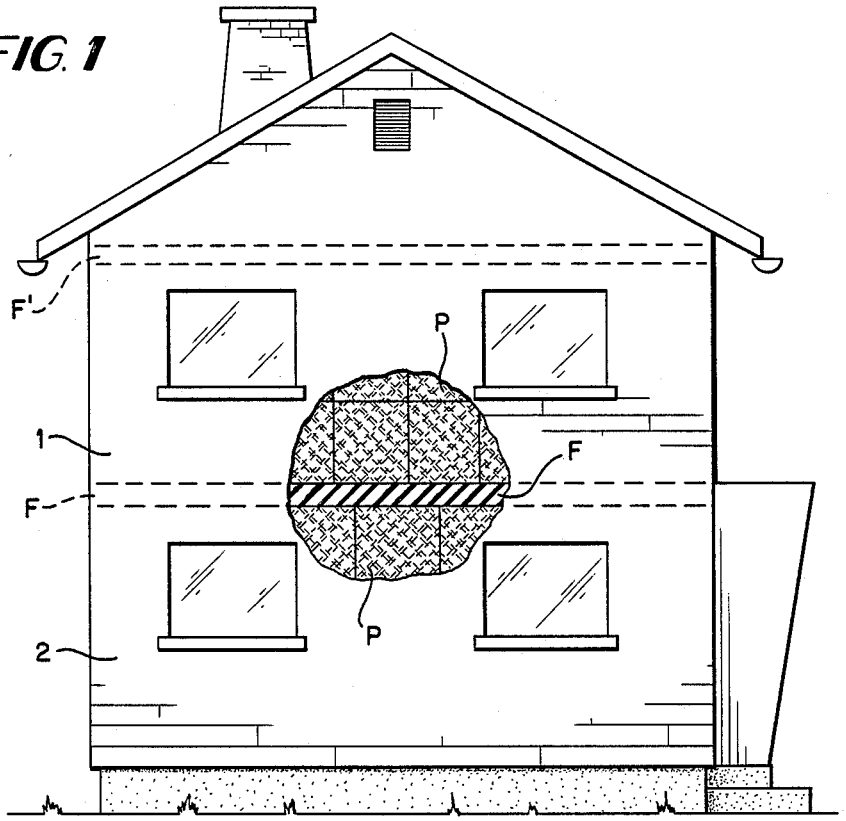
FIG. 1 is a schematic front view of the façade of a two-storey house covered with a heat insulation according to the invention comprising a flame-barrier beam.

The building façade shown in FIG. 1 is covered by an insulation consisting of panels P of the type described in Swiss Pat. No. 648,888. The panels P are internally ventilated by means of a system of channels or ducts K which extend below the frontal face of the panels P and which either extend vertically from the bottom to the top of the façade, or they are inclined relative to the vertical at an acute angle, intersecting each other, for instance, at an angle of 45°. The facade is covered by a conventional plaster or the like layer protective against attrition.

Figure 1A:
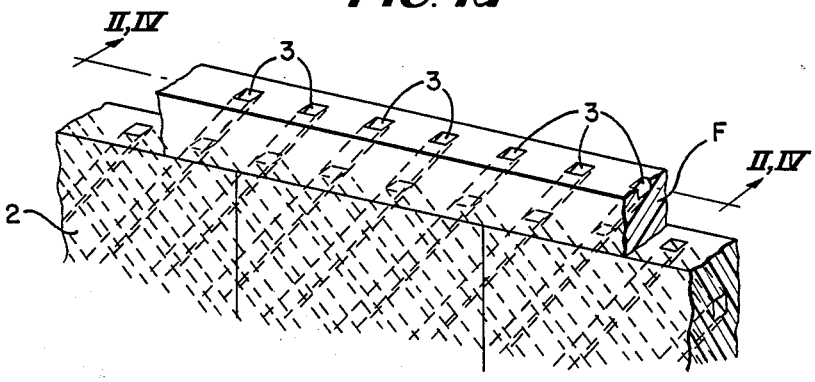
FIG. 1*a* is a view, in perspective, of a portion of the lower façade region and the barrier means thereon.
Figure 2:
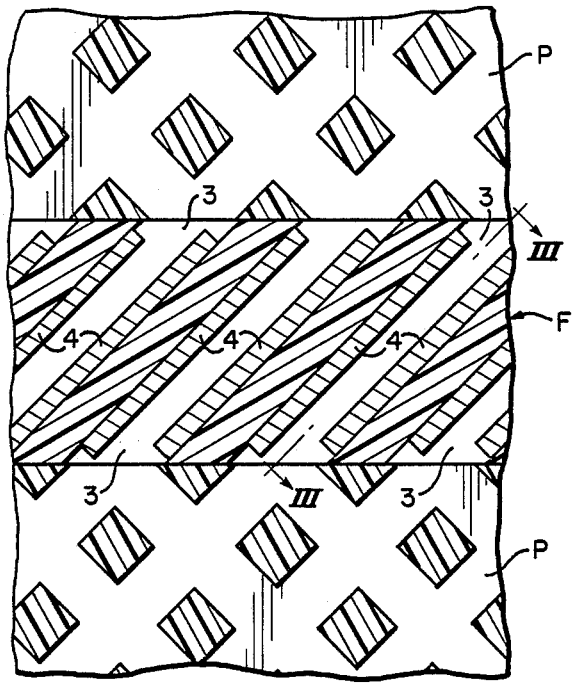
FIG. 2 is a cross-sectional view of a detail of the same heat-insulation taken along a plane indicated by II—II in FIG. 1*a* and comprising a preferred embodiment of a flame-barrier beam.
Figure 3:
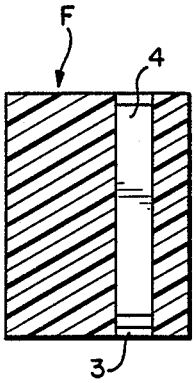
FIG. 3 is a 45° cross-sectional view taken through the embodiment of the flame-barrier beam of FIG. 2 and along a plane indicated by III—III therein.
Figure 6:
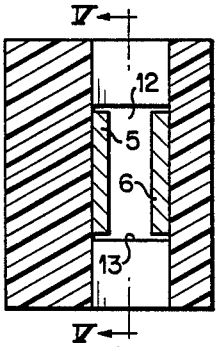
FIG. 6 is a cross-sectional view of the same embodiment, taken in a plane normal to the plane of FIG. 5 and indicated by VI—VI therein.
Figure 4:
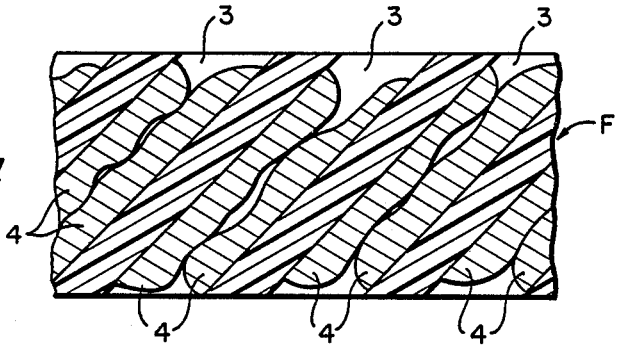
FIG. 4 is another cross-sectional view of the flame-barrier beam alone similar to the view thereof in FIG. 2, but with blocking means therein in inflated condition.
Figure 5:
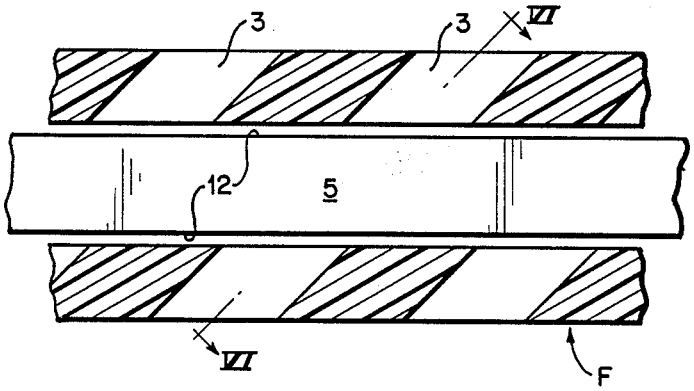
FIG. 5 is a cross-sectional view similar to that of FIG. 2, of another embodiment of the flame-barrier beam, in a plane indicated by V—V in FIGS. 1*a* and 6, infra.

The insulation panels of the façade are divided by a horizontal flame barrier constituted by a beam F into those of an upper façade region 1 and those of a lower façade region 2. The flame-barrier beam F consists of heat-resistant and -insulating non-combustible material and contains a number of beam ducts 3 which traverse the beam in a manner such that they interconnect the open top end of a ventilating channel K in the next adjacent panel P of the lower façade region 2, on which the beam F lies, with the open bottom end of a channel K in the next adjacent panel P of the upper façade region which rests in turn on the flame-barrier beam F (FIG. 1*a*). FIGS. 1–6 show beam ducts 3 inclined from one end, of beam F, to another while FIGS. 7–10 show an alternate embodiment wherein similar beam ducts 7, 8 are inclined from one side, of the flame -barrier beam, to another. As shown in FIG. 2 two thin duct-blocking elements 4 have been inserted in each of the beam ducts 3. These blocking elements consist of fire-resistant material capable of foaming whenever the temperature in the duct rises to a critical limit. When this happens, the elements 4 are foamed to increase their volume until they largely or completely obturate the respective beam duct 3 as shown in FIG. 4. This prevents the dangerous "chimney effect" which would otherwise make a fire jump from the lower façade region 2 to the upper facade region 1.

The number and arrangements of the duct-blocking elements 4 in the beam ducts 3 is of less importance than the adjustment of the capacity of the elements 4 to increase their volume when foaming, and the dimensions of the beam ducts 3 to each other in such a manner that, in the case of fire or another cause of increasing the temperature to the critical limit, the volume increase of the elements 4 will at least reduce the cross-sectional area of the ducts 3 by 80% or more, or preferably close them completely.

The blocking elements 4 consist, for instance, of hydrated sodium silicate ($Na_2SiO_3 \cdot H_2O$) containing optionally small amounts of organic adjuvants, e.g. silicone, to impart a higher degree of stiffness, and they are preferably reinforced mechanically by inlays of non-combustible fibers, such as glass fibers or wires, e.g. of aluminum, copper or another metal melting above 800° C. The elements 4 can also comprise a coating or envelope, e.g. of epoxy resin or aluminum foil, enclosing the reinforced sodium silicate body. Coated blocking elements of this type are sold by Badische Anilin- & Sodafabrik AG, D-6700 Ludwigshafen, West Germany, under the trade name Palusol. The enveloping aluminum foil or other envelope should be readily heat-conductive and should not hinder expansion of the blocking element 4, e.g. by foaming when the critical temperature limit is reached.

As materials for the flame-barrier beam I prefer a body of synthetic bonded glass-fibers which can be readily cut to size, or foamed water glass. The material can be heat-insulating as well as noise-reducing.

The number of flame barriers to be used in a given façade depends on the height of the latter. As a rule at least one such barrier should be inserted between two façade regions each of which covers a storey. Of course, a larger number of such barriers could also be used; for instance, in FIG. 1 an additional barrier F' could be provided under the roof, and a third barrier (not shown) could be provided closely below the windows of the first floor covered by the façade region 2.

The blocking agents 4 can be arranged in the beam ducts 3 in various ways. Particularly easy to assemble is an arrangement illustrated in FIGS. 5 and 6. In this case the beam F contains besides the inclined beam ducts 3 one long traverse horizontal channel 12 extending along the longitudinal beam axis, and the blocking elements are represented by two long stripes 5 and 6 which are inserted or placed in the channel 12 against the left hand and right hand walls, respectively, of the channel 12. The flexibility of the stripes 5 and 6 facilitates their insertion.

Of course, special recesses or grooves (not shown) can be provided in the internal sidewalls of the ducts 3 or channel 12 to receive the flame barrier elements 5 and 6, respectively therein, preferably near a joint between the flame-barrier beam F and the adjacent insulation panel P in the lower façade region 2.

Figure 7:
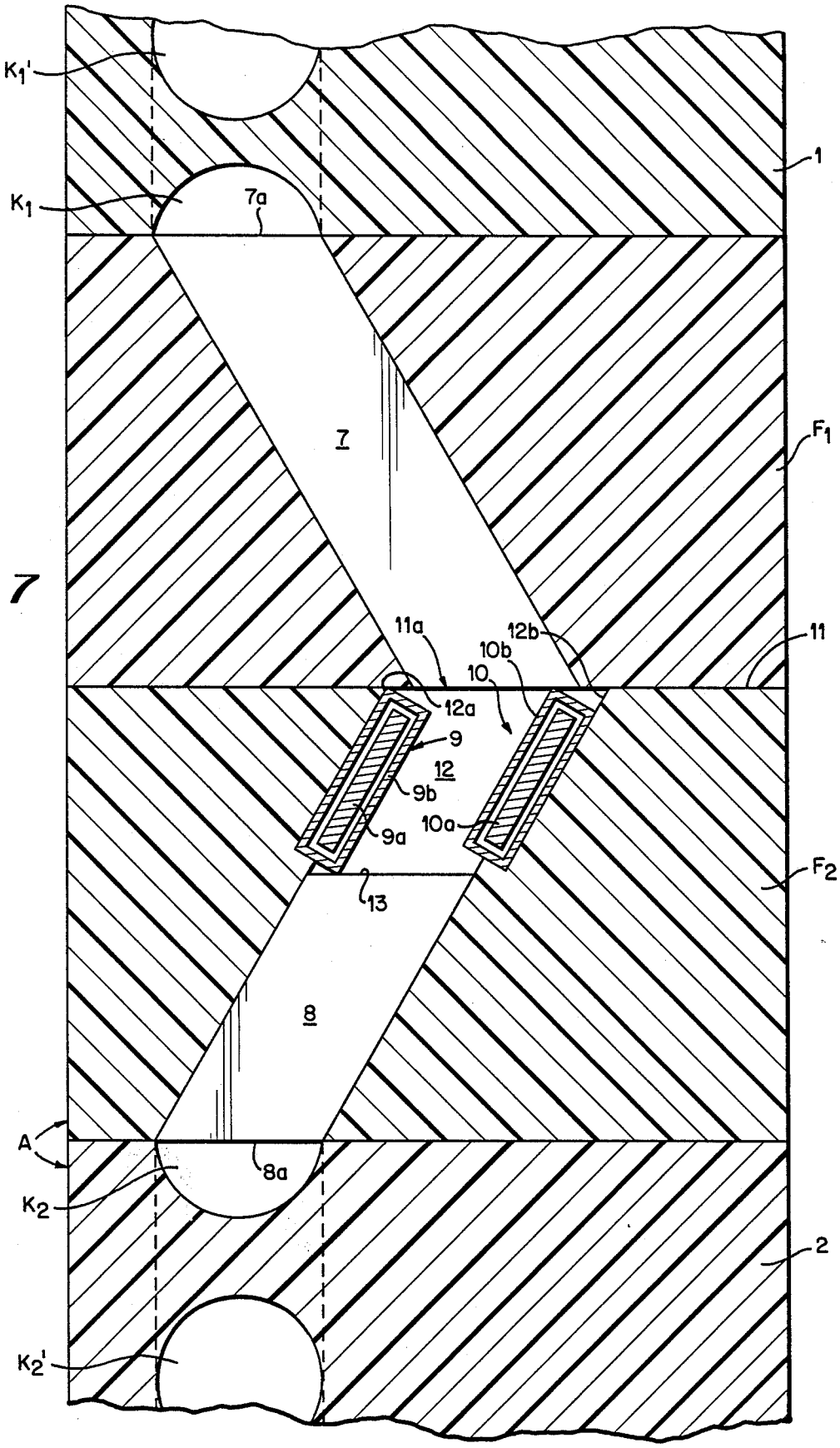
FIG. 7 is a cross-sectional view of another embodiment of the flame-barrier beam and the adjacent zones of insulation cover taken in a plane, as indicated by VII—VII in FIG. 8, below.
Figure 8:
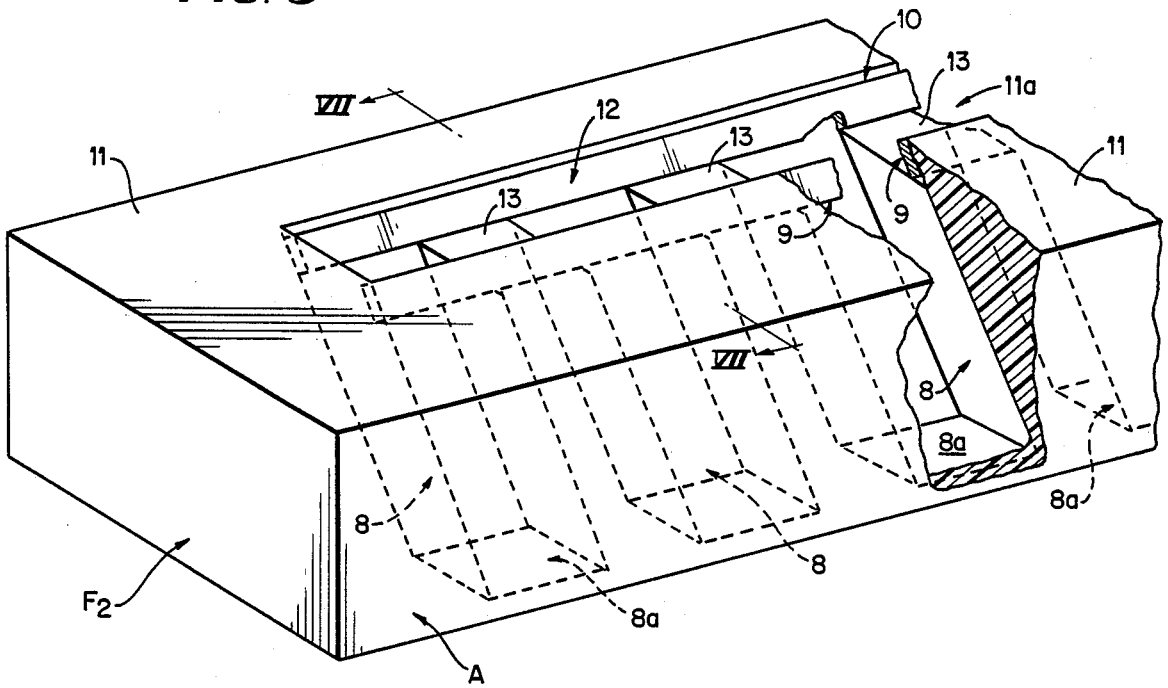
FIG. 8 is a perspective view, seen from above, and partly cut open of a lower half element of the same preferred embodiment as shown in FIG. 7.
Figure 10:
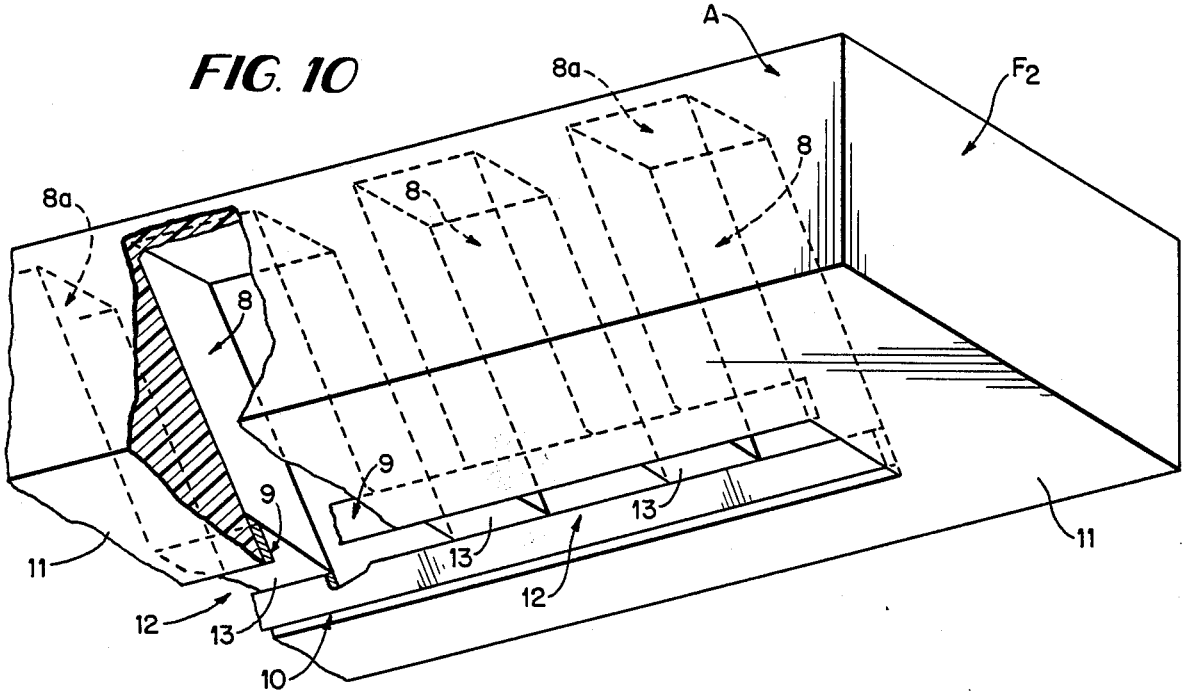
FIG. 10 is a perspective view, seen from below, and partly cut open of an upper half element of the same preferred embodiment as shown in FIG. 9.

The embodiment of a flame barrier according to the invention shown in FIGS. 7 and 8 consists of two half beams $F_1$ and $F_2$ the former placed upon the latter in a manner such that the two beam ducts 7 and 8 therein register with each other via their openings 11*a* in the joint plane 11. Only the lower half beam $F_2$ of FIG. 7 is shown in FIG. 8.

The duct 8 in the lower half beam $F_2$ extends from the joint opening 11*a* closer toward the frontal façade face A where it registers via its opening 8*a* with the ventilating duct $K_2$ in the lower panel of the lower insulating region 2 of the façade. The ventilating duct $K_2$ is inclined toward the vertical plane at an angle of 45°, and a parallel channel $K_2'$ is also visible.

In a similar manner, the duct 7 in the upper half beam $F_1$ establishes free communication between the joint orifice 11*a* and, via its upper orifice 7*a*, ventilating channel $K_1$ in the facade region 1 thereabove. Another channel $K_1'$, parallel with $K_1$ is also inclined at an angle of 45° relative to the vertical plane.

Figure 9:
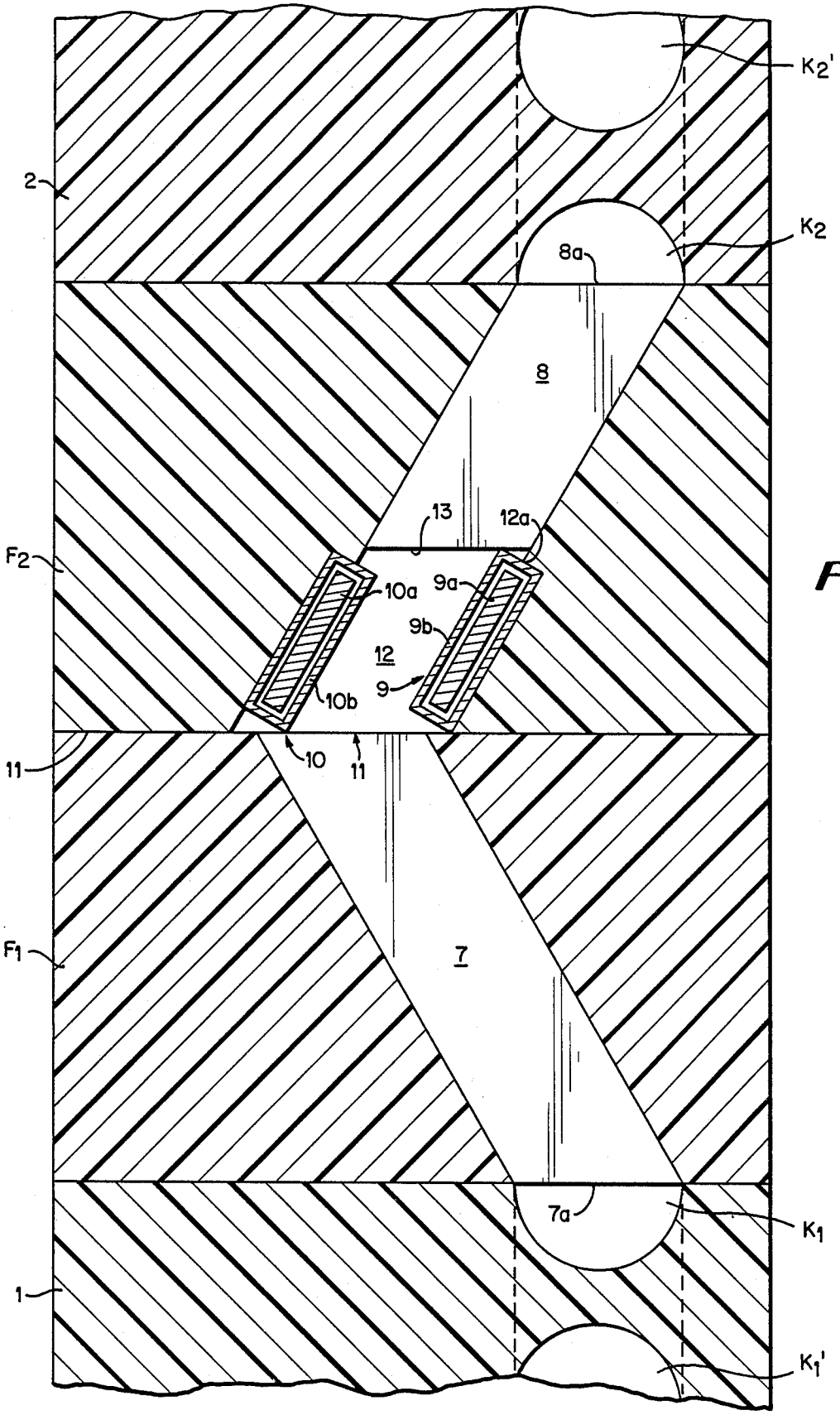
FIG. 9 is a similar view as shown in FIG. 7 but with the flame barrier in inverted position.

At the end of the beam duct 8 adjacent its junction with the duct 7, the duct 8 and all other such ducts extending parallel therewith through the upper half beam $F_2$, shown in FIG. 9 are intersected by a longitudinal channel or groove 12 opening downwardly over its entire length and extending parallel with the front face A of the façade; the top end face, being the groove bottom of the groove 12, is designated by 13.

In the left-hand and the right-hand walls of the channel or groove 12 there are provided longitudinal recesses or grooves 12*a* and 12*b*, respectively, in which there are partially inserted elongated duct-blocking strips 9 and 10. Each of these strips comprises a core 9*a*, 10*a* which is wrapped loosely in an aluminum foil 9*b*, 10*b* which does not hinder expansion by the formation of foam from the core 9*a*, 10*a*, whenever the temperature, for instance in the channels $K_2$, $K_2'$ etc. and the communicating portion of the duct 7 reaches a critical temperature.

As flames and hot air in a case of a fire soar upward in a single channel or a number of channels $K_2$, $K_2'$, they impinge on to the strip 10 in the respective beam duct or ducts 8 and are deflected toward the opposite strip 9 therein, and the heat in these strips will be distributed along the entire groove 12, thus causing not only the local portion of the strips contacted directly by flames and heat to expand, but the entire lengths of the strips 9 and 10 across the entire width of the facade region 2, thus closing all channels $K_2$ and suppressing any chimney effect before it can fully develop in these channels.

I claim:

1. An internally ventilated façade insulation comprising synthetic resin panels and extending between a lower end zone and an upper end zone of a façade having a determined height and width as well as ventilation ducts extending from said lower to said upper end zone substantially over the entire height of said façade, said façade insulation consisting essentially of (a) at least two horizontally extending façade regions, and (b) a flame barrier between said regions, having an upper end face and a lower end face and extending horizontally across substantially the entire width of the façade, at least one of said façade regions being a lower one having an upper region-end face and supporting said lower flame barrier end face thereon, and at least a second one of said façade regions being an upper one having a lower region-end face and resting therewith on said upper flame barrier end face, above said first façade region;

said flame barrier comprising (i) a plurality of barrier ducts, adapted for connecting ventilation ducts in said lower façade region with corresponding ducts in said upper façade region, and (ii) an elongated transverse channel extending substantially horizontally and transversely to said barrier ducts and intersecting said barrier ducts so as to be in free communication with said ventilation ducts therebelow and thereabove up to a temperature limit, and heat-expandable blocking means lodged in and extending along said transverse channel, and being adapted for expanding, when the temperature in said ventilation ducts located in said lower facade region adjacent said transverse channel reaches said temperature limit, in a manner such that at least about 80% of the cross-sectional area of each of said barrier ducts and upper façade region ducts is blocked off above said transverse groove.

2. The facade insulation of claim 1, wherein said flame barrier comprises (a) a first elongated substantially beam-shaped barrier element having said lower flame barrier end face and a first element upper face and (b) a second elongated, substantially beam-shaped barrier element having said upper flame barrier end face and a second element lower face, said second barrier element being superimposed on said first barrier element with said second element lower face resting on said first element upper face in a substantially horizontal joint plane;

said barrier ducts comprising (c) first element ducts extending through said first barrier element at an inclined angle relative to said lower and upper faces thereof, and having openings in each of said two faces of said first barrier element; and (d) second element ducts extending through said second barrier element in a direction intersecting the direction in which said first element ducts extend, and inclined relative to said upper and lower end faces of said second barrier element; said second element ducts having openings in said upper and lower faces of said second barrier element, and said transverse channel is constituted by an elongated groove in one of said barrier elements open in the face thereof on which the other barrier element rests, and extending in the same longitudinal direction as said barrier elements, said channel having sidewalls extending transversely to said joint plane;

said blocking means being mounted along at least one of said channel sidewalls.

3. The façade insulation of claim 2, wherein said barrier ducts and the ventilating ducts in an adjacent panel are inclined relative to the horizontal plane at an identical angle.

4. The flame barrier of claim 2, wherein said barrier ducts and the ventilation ducts in an adjacent facade region are inclined relative to the horizontal joint plane at an identical angle.

5. The flame barrier of claim 4, wherein each barrier duct is blockable by said blocking means being a plate- or strip-shaped element.

6. The flame barrier of claim 5, wherein said blocking means comprise a blocking element core consisting essentially of hydrated sodium silicate-type foamable substance, foaming agent and reinforcing material selected from non-combustible fibers and metal wire having a melting point above said critical temperature limit.

7. The flame barrier of claim 6, wherein said blocking element comprises, about said core, a thin envelope consisting of highly heat-conductive material of an aluminum foil-type and being free from impeding the expansion of said core.

8. The flame barrier of claim 7, wherein said barrier ducts have a cross-sectional area such, and said blocking element consists of a material whose expansion coefficient at said critical temperature limit is such, that said cross-sectional area of said barrier duct is blocked off by above 80% and up to 100%, when said blocking element expands.

9. A flame barrier comprising a beam-shaped barrier body adapted for being interposed between a lower and an upper façade region of an internally ventilated façade, having an upper and a lower face and a plurality of barrier ducts each extending between said upper and said lower face and opening therethrough and, at each of said barrier ducts, a non-combustible heat-expandable blocking means, being adapted for expanding, when the temperature in said barrier duct reaches a critical limit, in a manner such, that said blocking means expand to block off at least about 80% of the cross-sectional area of the respective duct; and said barrier ducts being inclined at an acute angle relative to said upper and lower barrier body faces.

10. The flame barrier of claim 9, wherein said barrier body has the configuration of a beam of substantially rectangular cross-section.

11. A beam-shaped elongated flame barrier adapted for being interposed between an upper face of a lower façade region and a lower face of an upper façade region, of an internally ventilated façade insulation having a plurality of ventilation ducts opening, respectively, through said upper and lower faces, and comprising (A) an elongated barrier block having a flat upper and a flat lower supporting block face, (i) a plurality of barrier ducts extending parallel with each other through said barrier block from said upper block face to said lower block face obliquely to, and opening through, both said block faces, (ii) an elongated transverse channel extending substantially horizontally through the interior of said barrier block in substantially the same longitudinal direction as said elongated block and intersecting said obliquely extending barrier ducts at an acute angle, said channel having right-hand and left-hand sidewalls in said barrier block extending transversely to said upper and lower block faces, and (B) heat-expandable obturating means lodged on at least one of the sidewalls of said channel and extending in the same longitudinal direction as said barrier block, said obturating means being adapted for expanding, when the temperature in said transverse channel reaches a determined temperature limit, in a manner such that at least about 80% of the cross-sectional area of each of said barrier ducts intersecting said transverse channel is obturated.

12. A flame barrier block adapted for being interposed between an upper face of a lower façade region and a lower face of an upper facade region, of an internally ventilated façade insulation having a plurality of ventilation ducts opening, respectively, through said upper and lower façade region faces, and comprising (a) a first elongated, substantially beam-shaped barrier element having an outer flame barrier end face and a first element inner face and (b) a second elongated, substantially beam-shaped barrier element having an outer flame barrier end face and a second element inner face, said first and second barrier elements being superimposed one upon the other with their inner faces in contact with each other in a substantially horizontally extending joint plane, said first and second barrier elements thereby forming a composite beam block having a longitudinal axis, (c) barrier ducts extending through said composite beam block and comprising (i) first element ducts extending through said first barrier element obliquely relative to said outer and inner faces thereof, and having orifices in said outer end face of said first barrier element; and (ii) second element ducts extending through said second barrier element obliquely relative to said second element outer and inner faces at an angle such as to intersect said first element ducts; said second element ducts having orifices in said outer end face of said second barrier element;

(d) an elongated groove extending in a direction parallel with said longitudinal axis and being recessed in the inner face of one of said first and second barrier elements and opening through said joint plane, said groove having a groove bottom and groove sidewalls flanking said groove, the barrier ducts in the barrier element containing said groove having orifices in said groove bottom, and the barrier ducts in the other barrier element having orifices located in said inner face of said other barrier element and opening toward said groove; and (e) heat-expandable obturating means lodged on at least one of said groove sidewalls and extending in a direction parallel with said longitudinal axis, said obturating means being adapted for expanding, when the temperature in said groove reaches a determined temperature limit, in a manner such that at least 80% of the cross sectional area of each of said barrier ducts opening into said groove is obturated.

* * * * *